US010416591B2

(12) United States Patent
Swantner et al.

(10) Patent No.: US 10,416,591 B2
(45) Date of Patent: Sep. 17, 2019

(54) TONER CARTRIDGE

(71) Applicant: HEWLETT-PACKARD DEVELOPMENT COMPANY, L.P., Houston, TX (US)

(72) Inventors: Richard L. Swantner, Rapid City, SD (US); Robin P. Yergenson, Eagle, ID (US); Dean J. Richtsmeier, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 38 days.

(21) Appl. No.: 15/434,167

(22) Filed: Feb. 16, 2017

(65) Prior Publication Data

US 2017/0160672 A1 Jun. 8, 2017

Related U.S. Application Data

(60) Division of application No. 15/143,468, filed on Apr. 29, 2016, now Pat. No. 9,618,898, which is a continuation of application No. 14/234,010, filed as application No. PCT/US2011/048445 on Aug. 19, 2011, now Pat. No. 9,341,981.

(51) Int. Cl.
*G03G 15/08* (2006.01)
*G03G 21/16* (2006.01)

(52) U.S. Cl.
CPC ..... *G03G 15/0865* (2013.01); *G03G 21/1609* (2013.01); *G03G 21/1619* (2013.01); *G03G 21/1666* (2013.01); *G03G 21/1676* (2013.01)

(58) Field of Classification Search
None
See application file for complete search history.

(56) References Cited

U.S. PATENT DOCUMENTS 3,277,807 A * 10/1966 Cranskens ..... G03B 27/16 355/119
6,129,216 A * 10/2000 Vandewinckel ..... B07B 1/46 209/243
6,621,513 B2 9/2003 Fukushima et al.
7,742,719 B2 6/2010 Williams et al.
7,761,025 B2 7/2010 Sato
7,880,757 B2 2/2011 Nakano et al.
(Continued)

FOREIGN PATENT DOCUMENTS

CN 101104339 1/2008
CN 101844456 9/2010
(Continued)

OTHER PUBLICATIONS

English machine translation of Japanese patent document, Takahashi (JP 2006-301467 A); "Image Forming Apparatus"; by Takahashi, Satoshi; published Nov. 2, 2006.
(Continued)

*Primary Examiner* — David M. Gray
*Assistant Examiner* — Geoffrey T Evans
(74) *Attorney, Agent, or Firm* — HP Inc. Patent Department

(57) ABSTRACT

In one example, a toner cartridge for a printer includes interconnected interior upper and lower toner supply chambers surrounding an exterior opening defined in part by diverging sidewalls and a sloping ceiling.

16 Claims, 20 Drawing Sheets

(56) References Cited

U.S. PATENT DOCUMENTS

| | | | |
|---|---|---|---|
| 8,269,810 | B2 | 9/2012 | Saiki |
| 9,025,997 | B2 | 5/2015 | Yokoi |
| 2004/0008246 | A1 | 1/2004 | Shim |
| 2007/0280743 | A1 | 12/2007 | Nakajima et al. |
| 2008/0056761 | A1 | 3/2008 | Kawahara et al. |
| 2008/0090164 | A1 | 4/2008 | Takeda |
| 2008/0138107 | A1 | 6/2008 | Mori |
| 2008/0152386 | A1 | 6/2008 | Sakaguchi et al. |
| 2008/0317520 | A1 | 12/2008 | Umezawa et al. |
| 2009/0324297 | A1 | 12/2009 | Usui |
| 2010/0040392 | A1 | 2/2010 | Wu et al. |
| 2010/0245529 | A1 | 9/2010 | Saiki |
| 2011/0064469 | A1 | 3/2011 | Itabashi |
| 2011/0110694 | A1 | 5/2011 | Ishikake |
| 2014/0153971 | A1 | 6/2014 | Swantner et al. |
| 2015/0049355 | A1 | 2/2015 | Richtsmeier et al. |
| 2015/0050045 | A1 | 2/2015 | Sato et al. |
| 2015/0093142 | A1 | 4/2015 | Nogami et al. |
| 2016/0132012 | A1 | 5/2016 | Swantner et al. |

FOREIGN PATENT DOCUMENTS

| | | |
|---|---|---|
| JP | 61156177 | 7/1986 |
| JP | 2000199993 | 7/2000 |
| JP | 2002099136 | 4/2002 |
| JP | 2006088598 | 4/2006 |
| JP | 2006301467 | 11/2006 |
| JP | 2009222858 | 10/2009 |

OTHER PUBLICATIONS

European Search Report, dated Apr. 24, 2015, European Patent Application No. 11871263.7, Hewlett-Packard Development Company, LP.

* cited by examiner

TONER CARTRIDGE

CROSS REFERENCE TO RELATED APPLICATIONS

This is a divisional of U.S. application Ser. No. 15/143,468 filed Apr. 29, 2016 which is a continuation of U.S. application Ser. No. 14/234,010 filed Jan. 21, 2014, now U.S. Pat. No. 9,341,981, which is itself a 35 U.S.C. 371 national stage of international application Ser. No. PCT/US2011/048445 filed Aug. 19, 2011, all of which applications are incorporated herein by reference in their entirety.

BACKGROUND

The printing process used in many laser printers and other such electrophotographic printers involves applying a uniform surface charge to a photoconductor and then exposing the photoconductor to imaging light that discharges the photoconductor in select areas to define a latent electrostatic image on the photoconductor. The latent image is developed by depositing toner on the surface of the photoconductor. The toner adheres to the imaged areas of the photoconductor to form a developed image that is transferred to paper or another imaging substrate. The toner supply is usually contained in a replaceable cartridge that sometimes also houses the photoconductor and other image development components of the printer.

DRAWINGS

Figure 17:
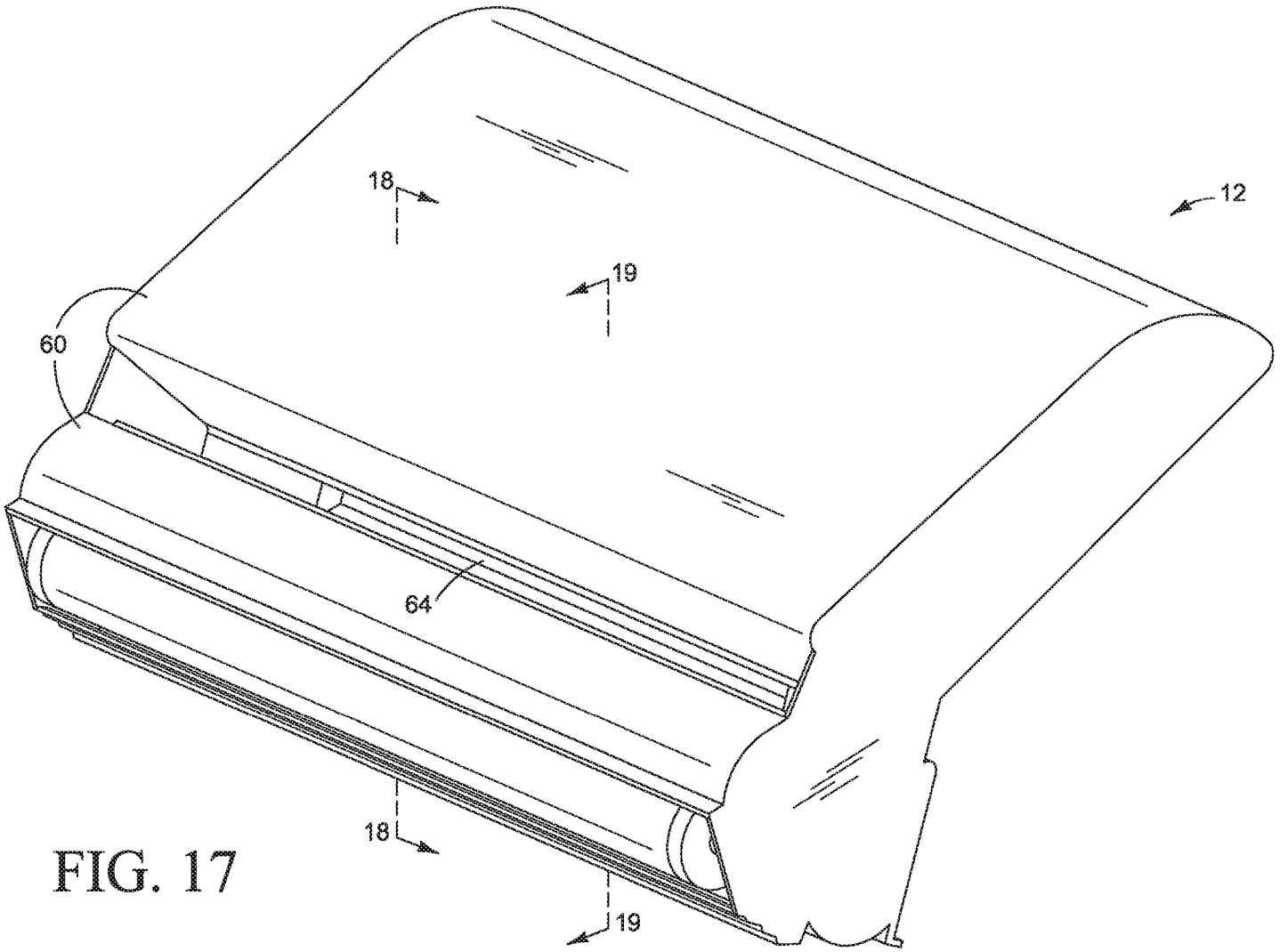
FIG. 17 is a perspective view of the toner container in the printer of FIG. 16.
Figure 18:
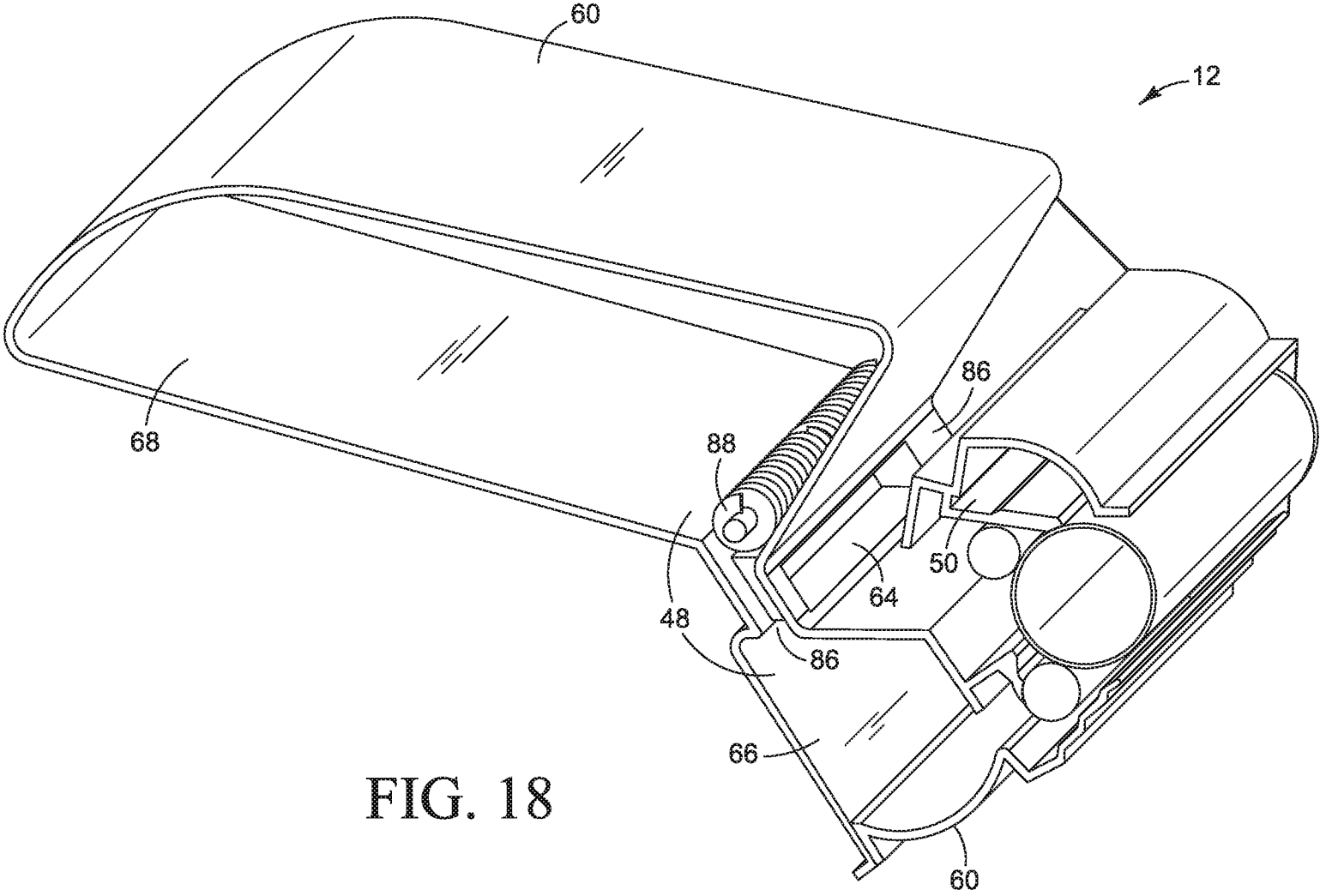
Figure 19:
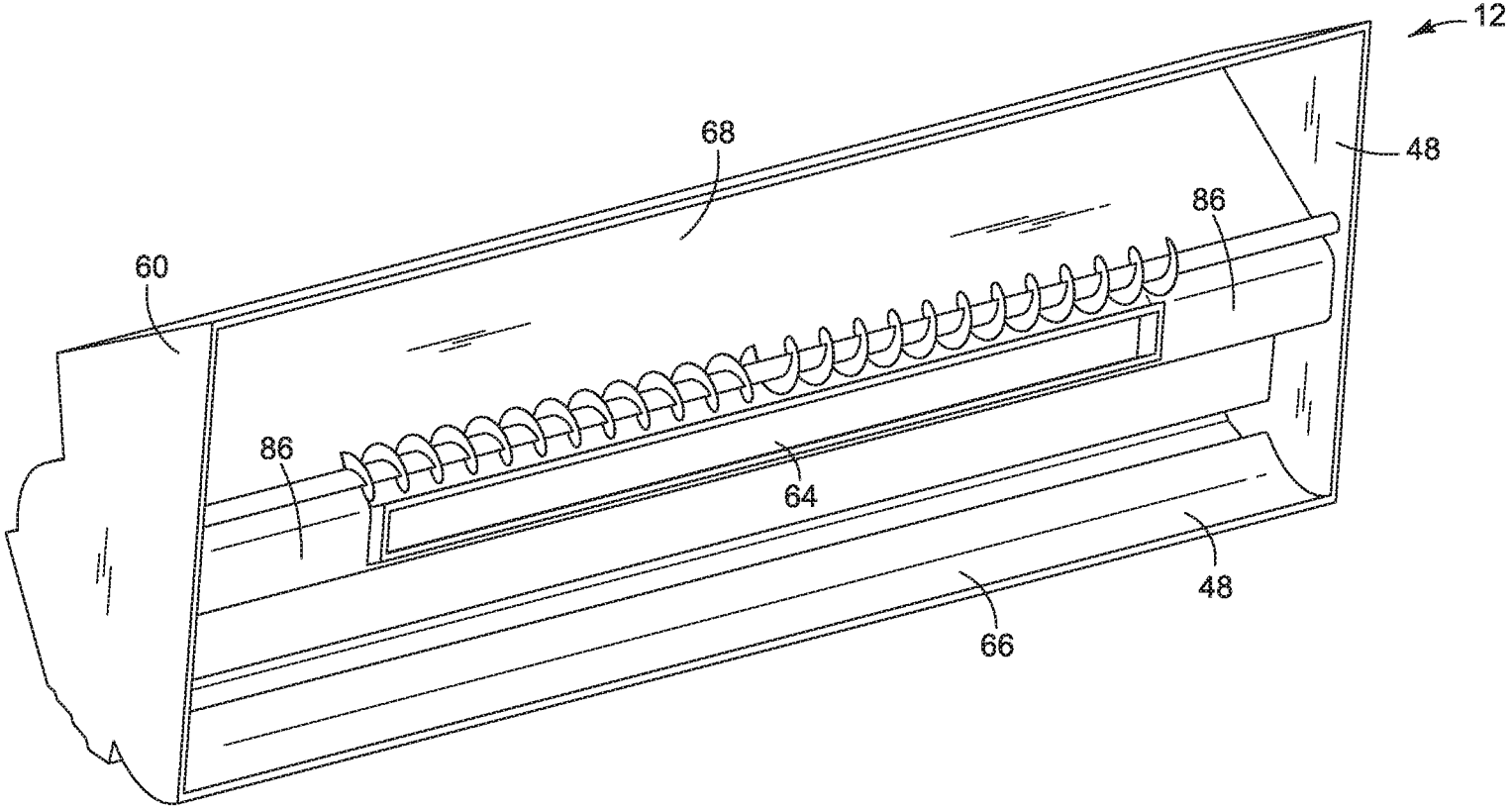

FIGS. 18 and 19 are section views taken along the lines 18-18 and 19-19 in FIG. 17.

The section views have been simplified in some instances to better illustrate certain features, for example by omitting cross-hatching and some background structures. The same part numbers are used to designate the same or similar parts throughout the figures.

DESCRIPTION

Examples of the present invention were developed to increase the toner supply capacity in some electrophotographic printers without also increasing the size of the printer (or to reduce the size of the printer needed to accommodate an increased toner supply capacity). A larger toner supply reduces the need for the user to purchase replacement toner supply cartridges over the expected useful life of the printer. In some examples, a new toner supply container is sufficiently enlarged to eliminate the need for the user to replace the original toner container without also increasing the size of the printer. In such examples, the toner container may be configured as a non-removable component that simplifies printer construction, and simplifies user operation by eliminating the need to remove a spent toner cartridge and replace it with a new toner cartridge. Also, as a non-removable component, the toner container may be integrated into the printer structure as a load bearing member and/or as part of the printer exterior, thus replacing conventional discrete load bearing structures and/or exterior features.

Some examples of the new toner container facilitate the implementation of a novel printer use model in which printing capacity may be purchased incrementally, as desired, to help the user control printing costs. In these examples, the same toner container may be used for both fixed page count printers in which only the amount of toner needed to satisfy the fixed page count is supplied with the printer, or for variable page count printers in which the user may purchase access to additional printing capacity using toner originally supplied with the printer.

Examples of a new toner container and new printer configurations will be described with reference to an electrophotographic printer with an imaging light path typical of a scanning laser printer in which enlarging the toner container may be particularly challenging. Examples of the new toner container and the new printer configurations, however, are not limited to scanning laser printers. Examples might also be implemented in LED scan bar and other types of electrophotographic printers. "Printer" as used in this document means any printing device including but not limited to "printers", "copiers", MFPs (multi-function printers), and AiOs (all-in-one printers). The examples shown in the figures and described below illustrate but do not limit the invention, which is defined in the Claims following this Description.

Figure 1:
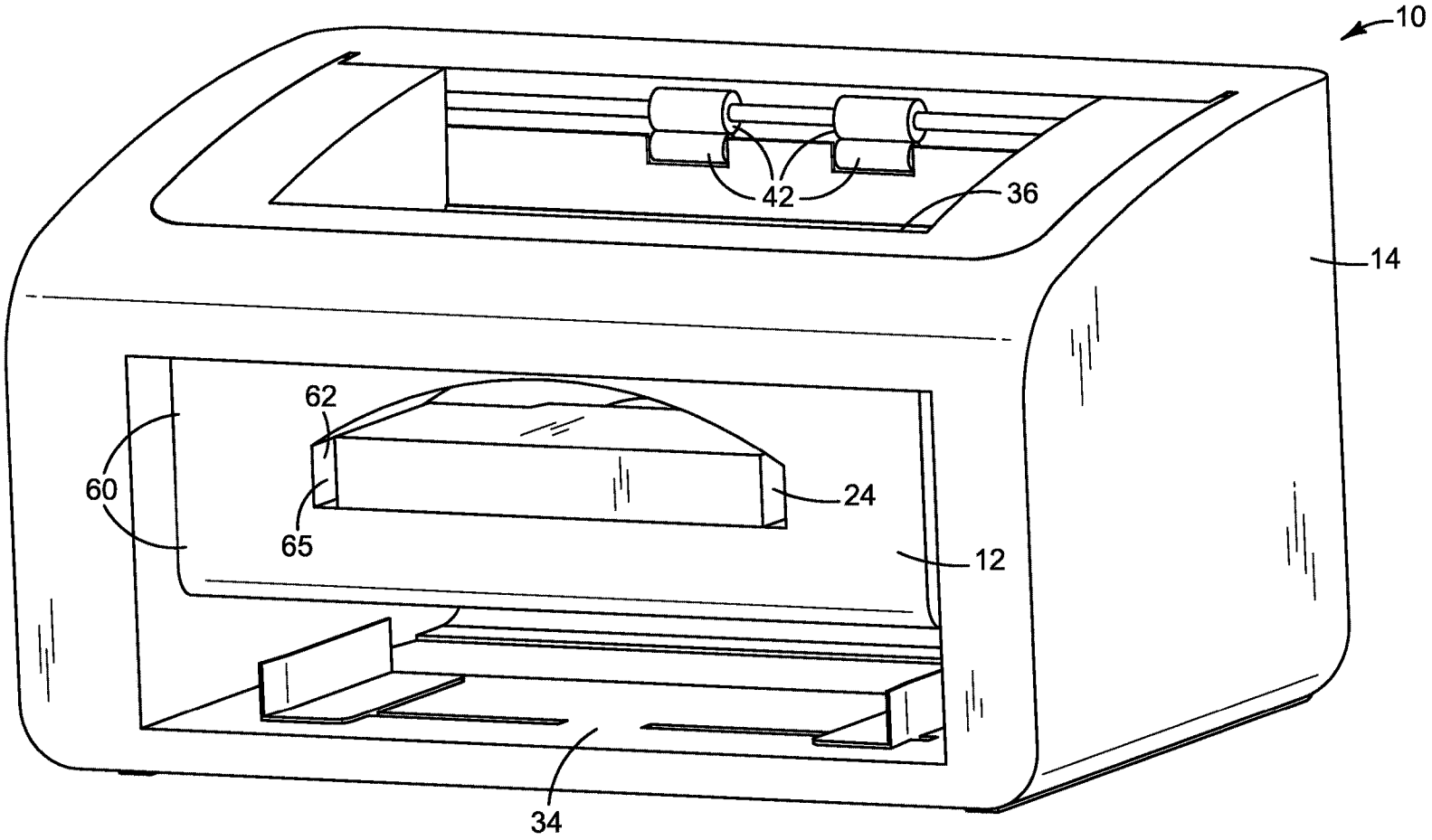
FIGS. 1 and 2 are perspective and side views, respectively, illustrating one example of a toner container for an electrophotographic printer.
Figure 2:
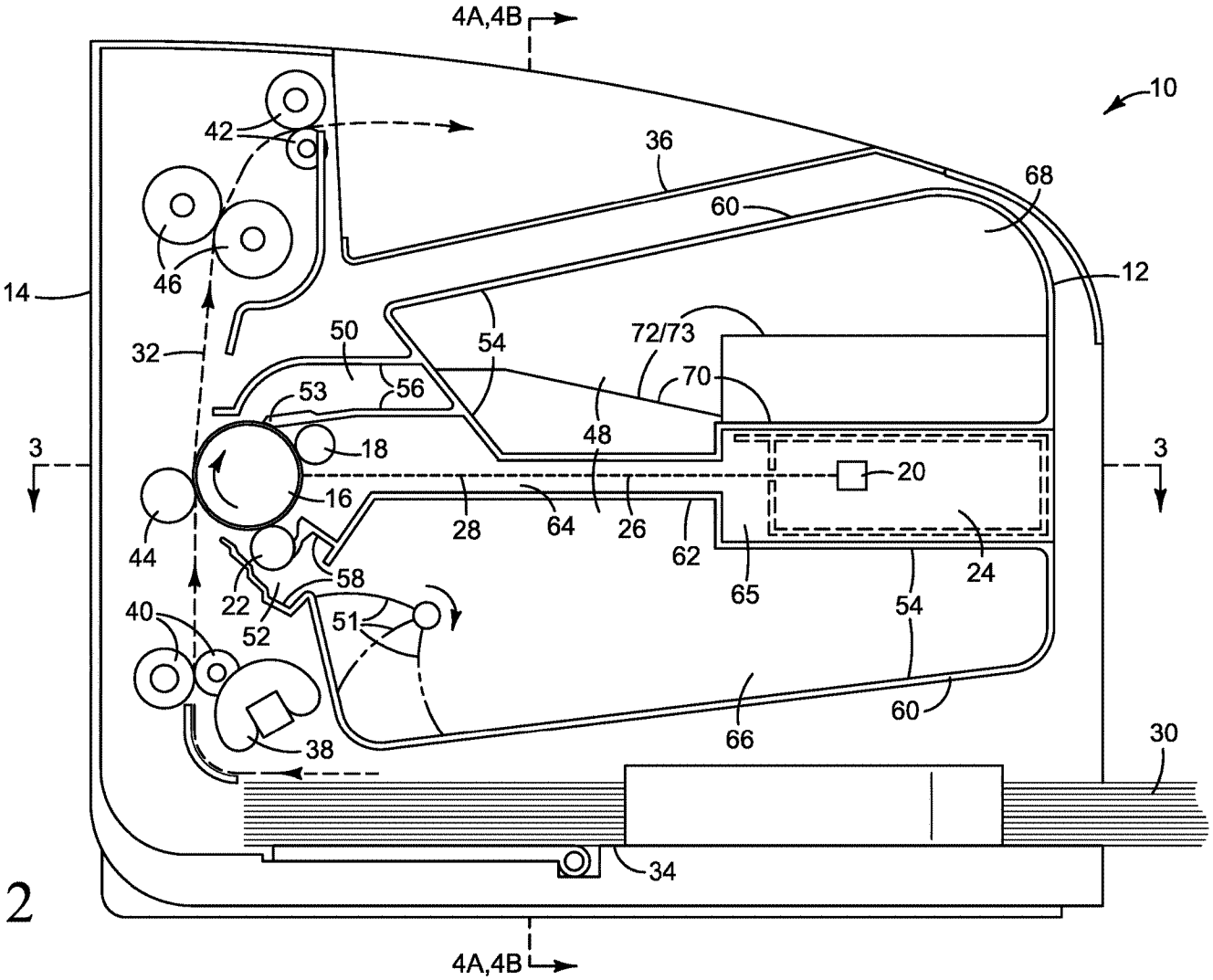

FIGS. 1 and 2 are perspective and elevation views, respectively, illustrating an electrophotographic printer 10 with a toner container 12. Referring to FIGS. 1 and 2, printer 10 includes a housing 14 that forms the exterior of printer 10 and generally supports the operative components of printer 10. Printer "housing" as used in this document includes load bearing and other supporting structures in the printer as well as the exterior features of the printer. In many electrophotographic printers a uniform surface charge is applied to a photoconductor and then the photoconductor is exposed to imaging light that discharges the photoconductor in select areas to define a latent electrostatic image on the photoconductor. The latent image is developed by depositing toner on the surface of the photoconductor. The toner adheres to the imaged areas of the photoconductor to form a developed image that is transferred to paper or another imaging substrate.

Thus, and referring specifically to FIG. 2, printer 10 includes: a photoconductor roller 16 that has a photoconductive surface on which the latent image is formed and the toner image is developed; a charging roller 18 for applying a uniform surface charge to photoconductor 16; a laser or other suitable light source 20 for exposing photoconductor 16 to imaging light for discharging photoconductor 16 in the desired pattern; and a developer roller 22 for applying toner to photoconductor 16. Although the photoconductive element 16, the charging device 18, and the developer unit 22 are shown as rollers, other suitable mechanisms or configurations for each element may be used. The configuration of printer 10 in FIG. 2, therefore, illustrates just one example configuration for these operative elements of an electrophotographic printer. Also, although the configuration of printer 10 in FIG. 2 represents a monochrome printer, this and other examples of a new toner container 12 may be implemented in a color printer.

In the example shown in FIGS. 1 and 2, light source 20 is housed in a module 24 that may also house, for example, a lens, a mirror, circuitry, and/or other components needed to accurately project a beam of light 26 along a horizontal light path 28 onto photoconductor 16.

Referring again specifically to FIG. 2, a sheet of paper or other print substrate is picked from a stack 30 and fed along a substrate path 32 from an input tray 34 to an output tray 36. Each substrate sheet is picked from stack 30 and fed along path 32 using, for example, a pick roller 38, feed rollers 40 and output rollers 42. Toner is applied to each sheet as it passes between photoconductor 16 and a transfer roller 44. For a dry toner electrophotographic printing process, the toner is affixed to the sheet as it passes through a nip between fusing rollers 46 which apply heat and pressure simultaneously to the print substrate.

Figure 3:
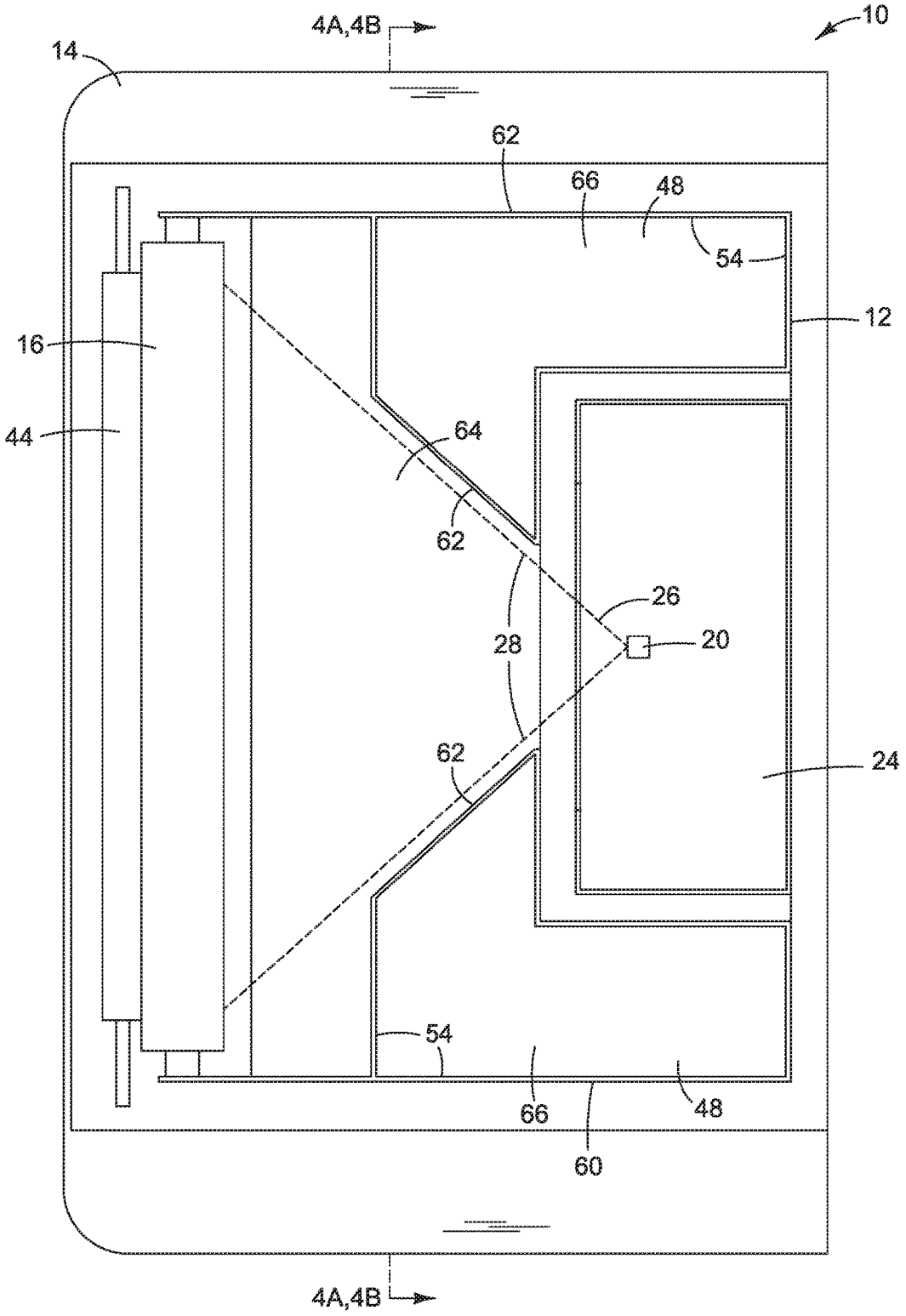
FIG. 3 is a section view taken along the line 3-3 in FIG. 2.
Figure 4A:
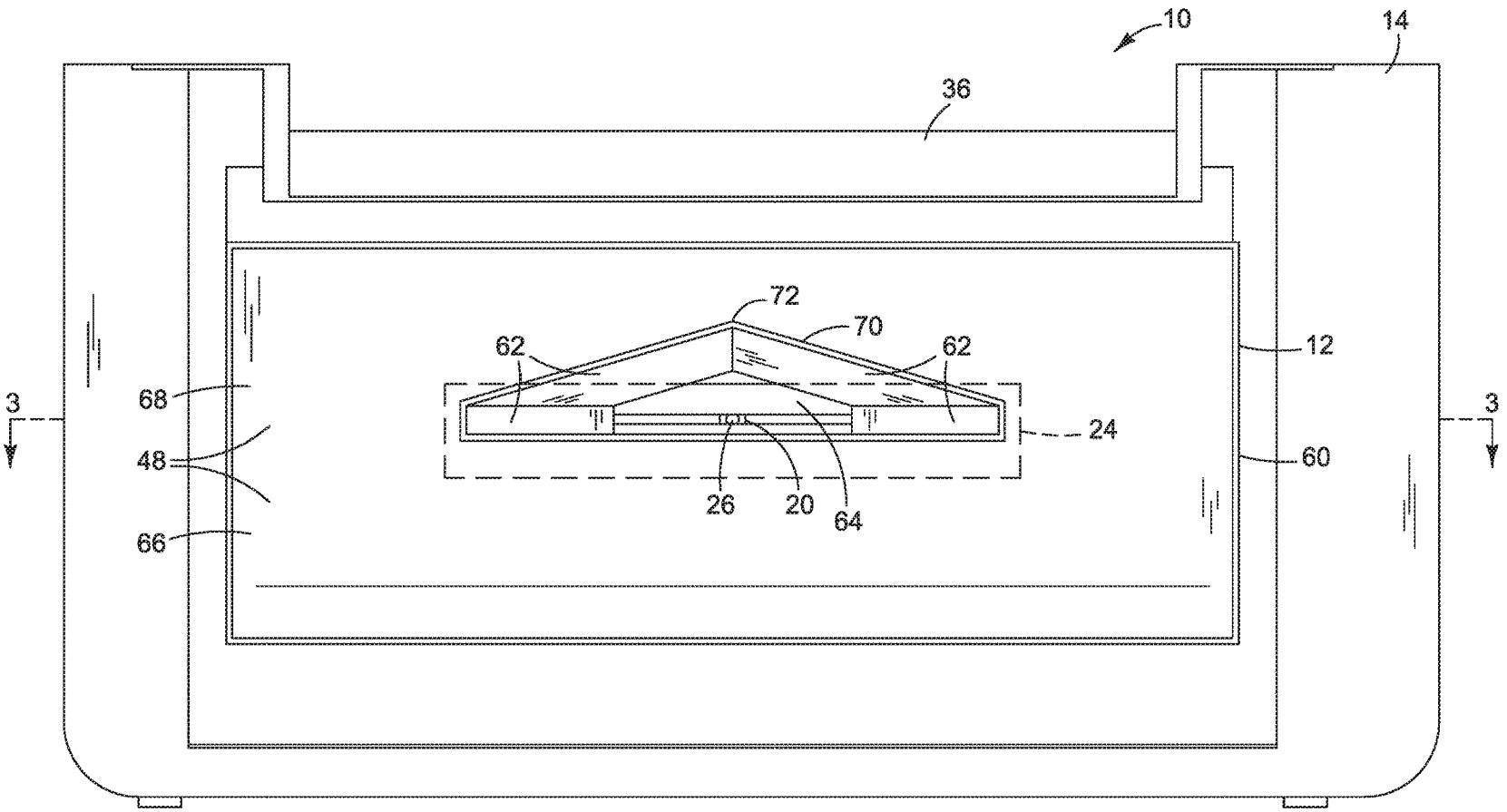
FIGS. 4A and 4B are section views taken along the line 4A/4B-4A/4B in FIG. 2 illustrating two example configurations for the upper chamber in the toner container shown in FIGS. 1 and 2.
Figure 4B:
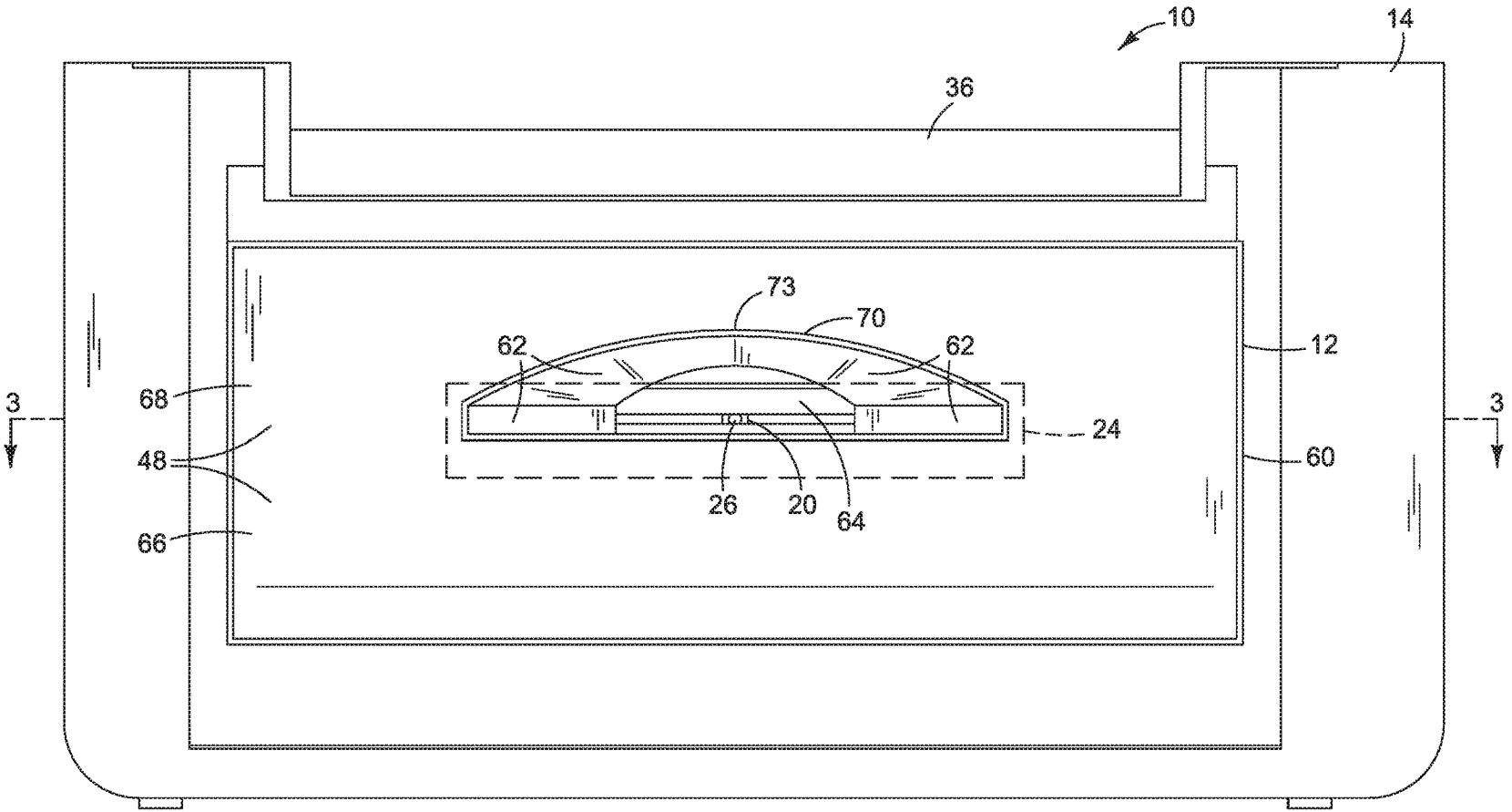
Figure 5:
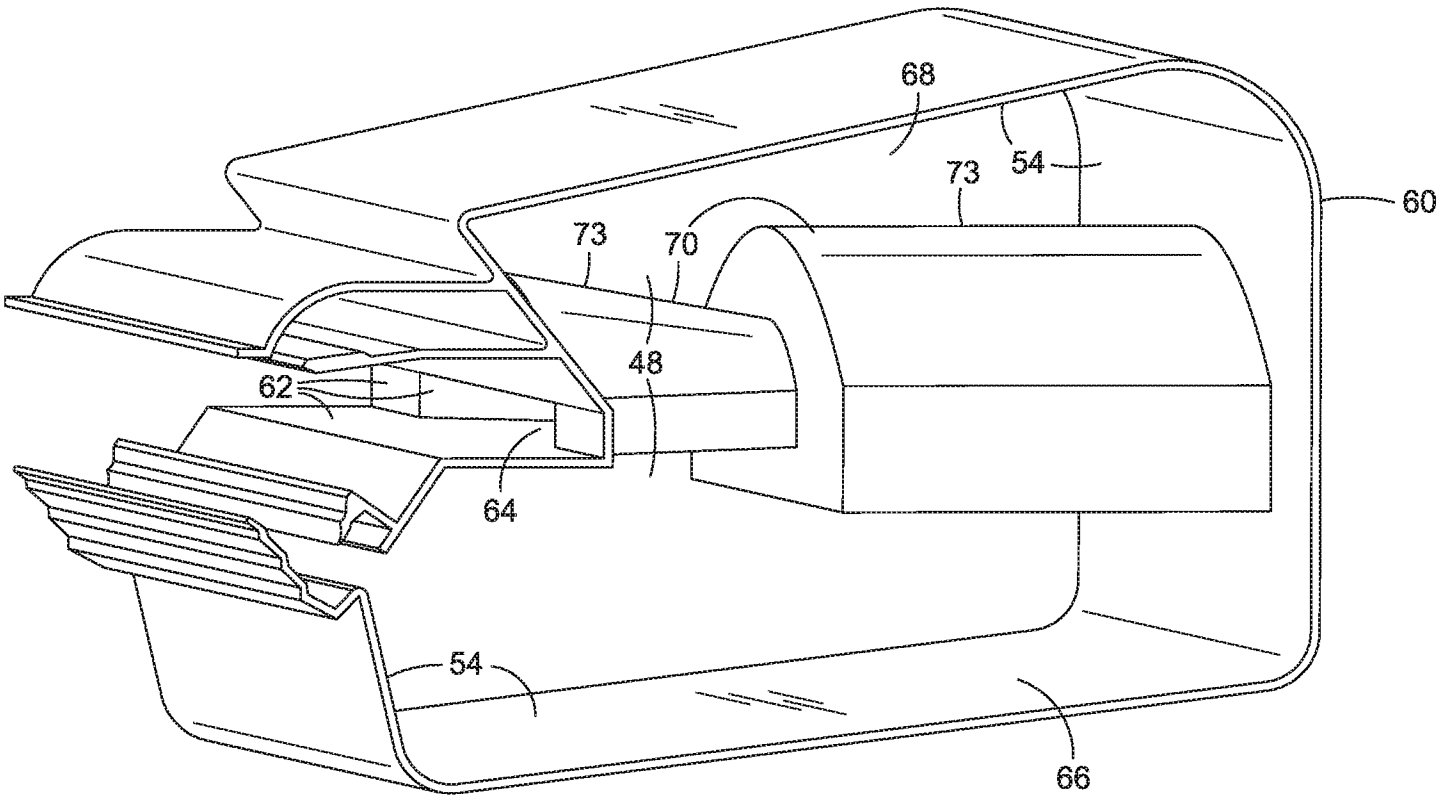
FIGS. 5 and 6 are side and section perspective views, respectively, illustrating the housing for the toner container of FIGS. 1-3 in the domed configuration of FIG. 4B.
Figure 6:
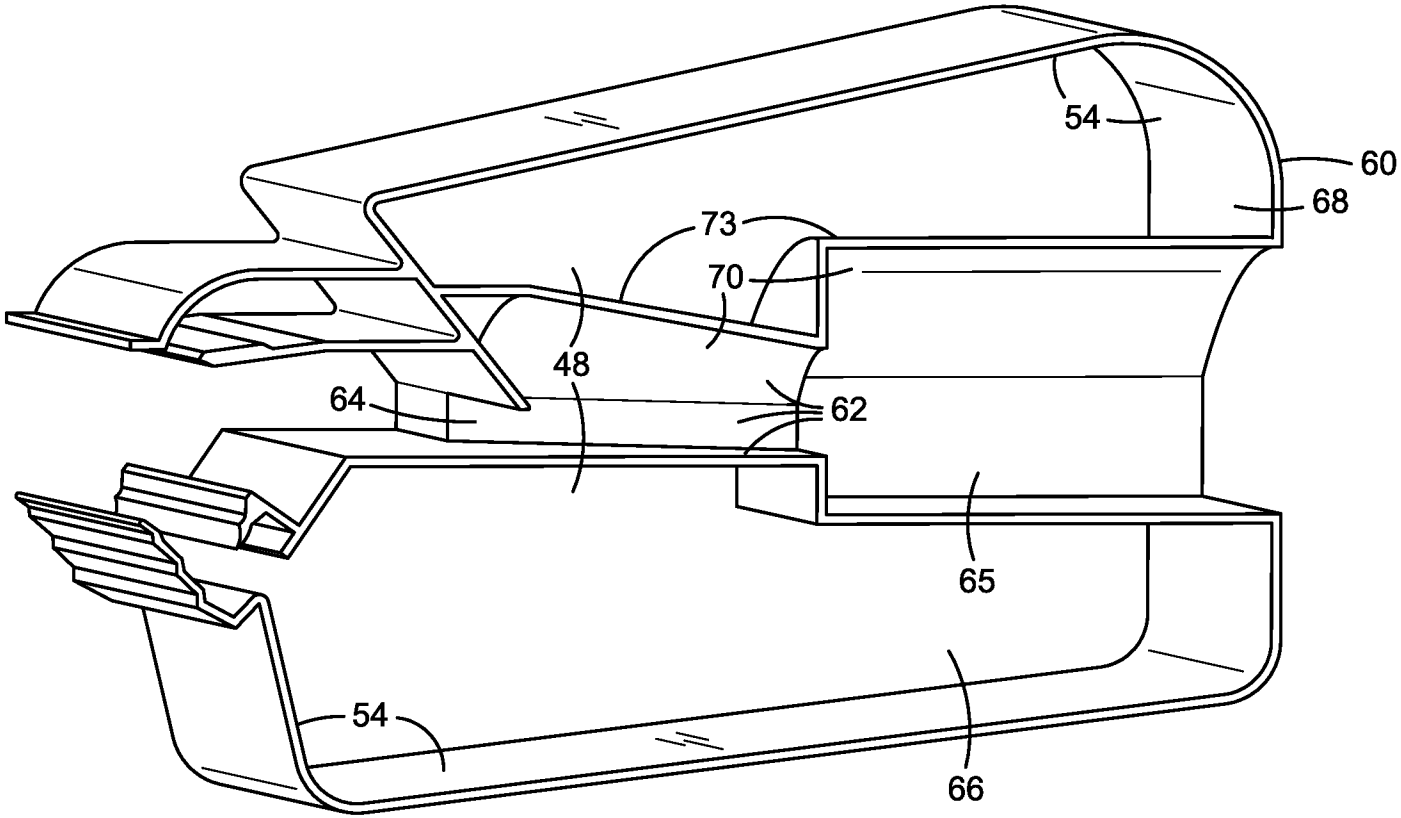

FIG. 3 is a section view taken along the line 3-3 in FIG. 2. FIGS. 4A and 4B are section views taken along the line 4A/4B-4A/4B in FIG. 2 illustrating two example configurations for part of container 12. FIGS. 5 and 6 are side and section perspective views, respectively, illustrating the housing for toner container 12 in the domed configuration of FIG. 4B. Referring now to FIGS. 2-6, toner container 12 includes a toner supply reservoir 48 for holding fresh toner, a waste reservoir 50 for holding used toner, and a hopper 52 from which fresh toner is supplied directly to developer roller 22. A rotating paddle 51 in reservoir 48 sweeps fresh toner from supply reservoir 48 into hopper 52. (The rotation of paddle 51 is indicated by a direction arrow and dotted lines in FIG. 2.) A cleaning blade 53 scrapes residual toner off the rotating photoconductor 16 into waste toner reservoir 50. Reservoirs 48, 50 and hopper 52 are defined by respective interior regions 54, 56, and 58 of a container housing 60. An exterior region 62 of housing 60 defines an opening 64 surrounding light path 28 that allows imaging light beam 26 to pass unobstructed to photoconductor 16.

Toner supply reservoir 48 may be characterized as having interconnected lower and upper chambers 66 and 68. Lower chamber 66 lies below lighting module 24 and imaging light path 28 and extends longitudinally from hopper 52 near photoconductor 16 at the rear of printer 10 forward to near the front of printer 10. Thus, lower chamber 66 extends longitudinally a distance greater than the length of light path 28. (The length of light path 28 is defined by the distance along a straight line radially out from photoconductor 16 to light source 20.)

As best seen in FIG. 3, lower chamber 66 and upper chamber 68 extend laterally a width substantially equal to or greater than the axial length of photoconductor 16. "Substantially" as used in this document for describing the width of toner supply reservoir 48 or the width of one of the chambers in toner supply reservoir 48 means the width of imaging light that can be projected on to photoconductor 16. Lower chamber 66, therefore, is configured to occupy substantially the full volume of available space below light path 28 and lighting module 24, and toner supply reservoir 48, including both chambers 66 and 68, is configured to occupy substantially the full volume of available space around light path 28.

As best seen in FIG. 3, imaging light beam 26 is scanned or otherwise projected across substantially the full axial length of photoconductor 16 to form a wedge shaped light path 28. A similarly wedge shaped opening 64 in container 12 helps maximize the capacity of reservoir 48. In the configurations shown in FIGS. 4A and 4B, the floor 70 of upper chamber 68 (which is the ceiling of opening 64) is shaped to allow toner in upper chamber 68 to flow passively (under the influence of gravity) into lower chamber 66. In the configuration of FIG. 4A, upper chamber floor 70 forms a peak 72 to urge toner down along floor 70 toward lower chamber 66. In the configuration shown in FIG. 4B, upper chamber floor 70 forms a dome 73 to urge toner down along floor 70 toward lower chamber 66.

Referring again to FIG. 2, in this example for container 12, the imaging system components may be housed together as part of a removable cartridge in which photoconductor 16, charging roller 18 and developer roller 22 are permanently affixed to container housing 60 at the rear of the cartridge. Imaging light module 24 is housed at the front of the cartridge in a pocket 65 surrounded by reservoir 48. Light module 24 may itself be a removable component detachable from container housing 60, or light module 24 may be permanently affixed to container housing 60. Other configurations are possible. For one example, container 12 may be separate from the imaging system components to function solely as a toner supply reservoir, either as a removable cartridge or as a non-removable supply container.

For less expensive, lower volume printers 10, an enlarged toner supply reservoir 48 such as that shown in FIGS. 1-6 can have sufficient capacity to store enough toner to print a minimum number of pages that corresponds to a predetermined expected useful life of the printer. "Predetermined" in this context means a determination of expected useful life made before the printer is put into service, for example by the manufacturer as part of the specifications for the printer. In one example for an inexpensive laser printer designed for personal and small business use, the predetermined expected useful life of the printer may be about 30,000 printed pages. The configuration of toner container 12 and supply reservoir 48 shown in FIGS. 1-6 used in such a printer could easily store enough toner to print 30,000 pages, thus supplying toner for printing throughout the predetermined expected useful life of the printer.

Figure 7:
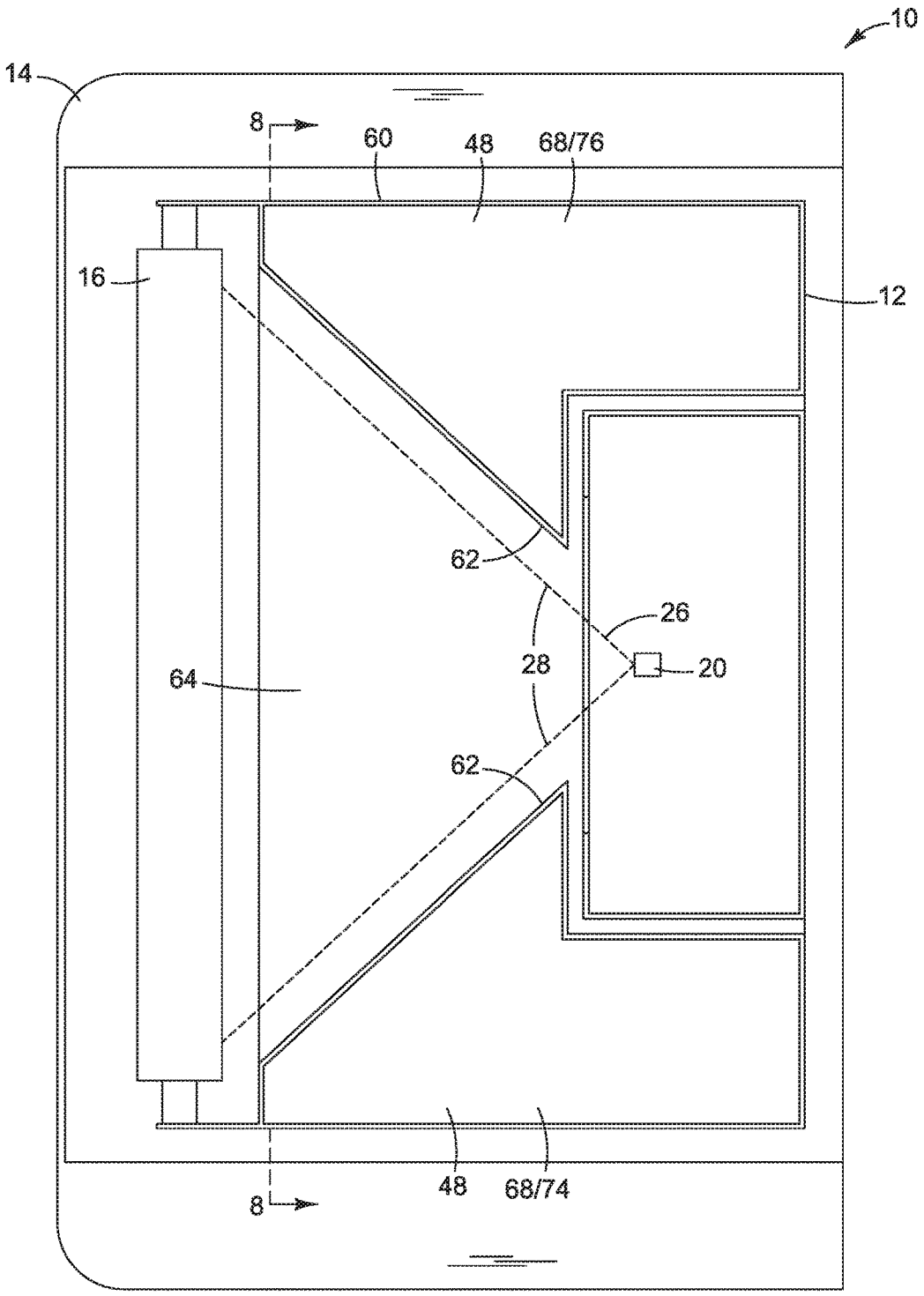
FIGS. 7 and 8 are plan and front section views, respectively, illustrating another example of a toner container for an electrophotographic printer in which the toner supply chamber includes towers along each side of the imaging light path.
Figure 8:
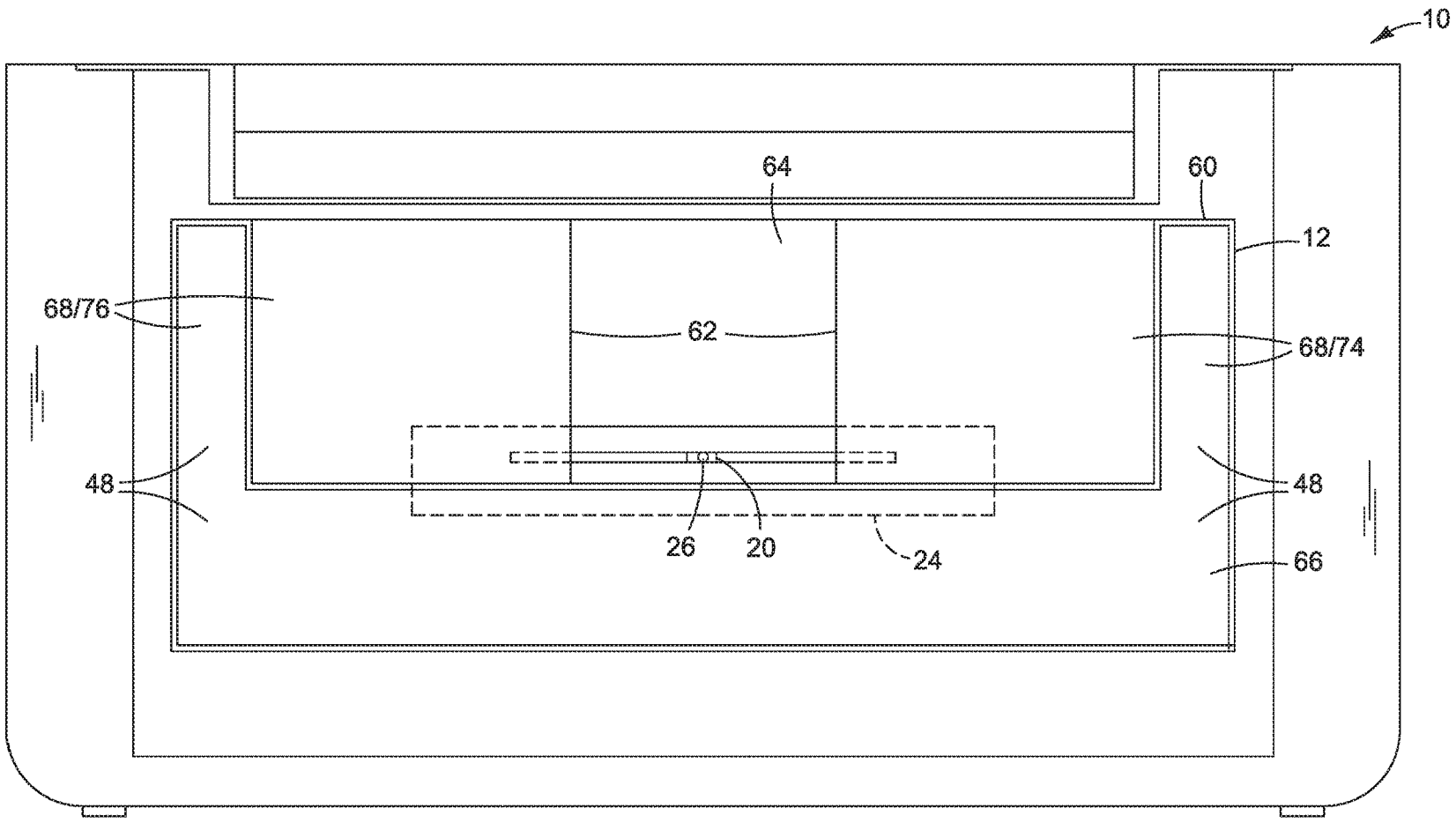

FIGS. 7 and 8 are plan and elevation views, respectively, illustrating another example of a toner container 12 in which toner supply reservoir 48 includes towers 74, 76 along each side of light path 28. Thus, in this example, reservoir upper chamber 68, defined by towers 74 and 76, does not extend over light path 28. Although the tower configuration of FIGS. 7 and 8 may provide less storage capacity than the configuration shown in FIGS. 1-3, it has the advantage of a more simple design that allows toner to move from upper chamber 68 into lower chamber 66.

Figure 9:
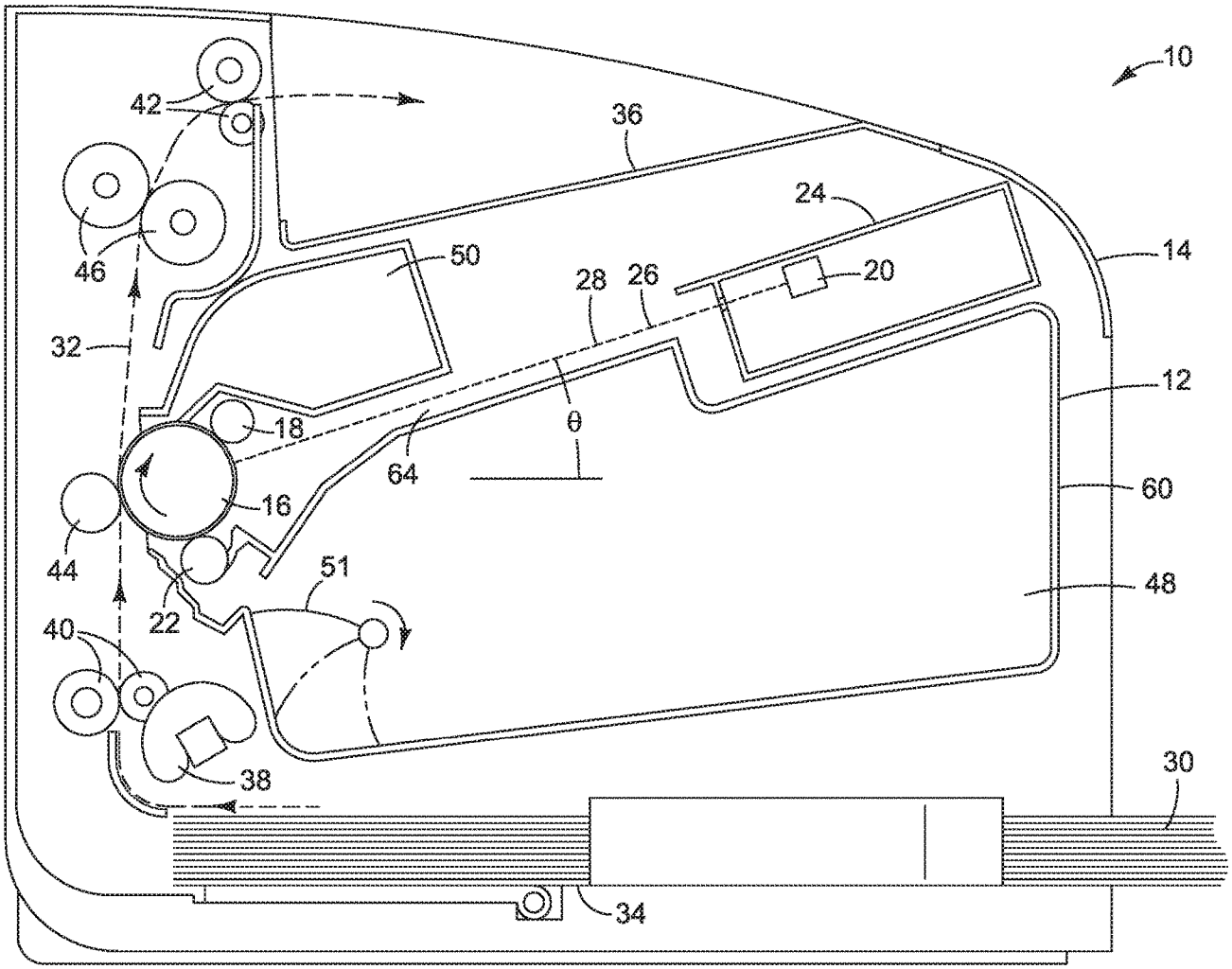
FIG. 9 is a side view illustrating one example of an electrophotographic printer and toner container in which the imaging light path is elevated at an acute angle above horizontal and the toner supply reservoir lies below the imaging light path.

FIG. 9 is an elevation view illustrating an electrophotographic printer 10 and toner container 12 in which imaging light path 28 is elevated and toner supply reservoir 48 lies below imaging light path 28. Referring to FIG. 9, imaging light module 24 is positioned high in printer housing 14 to elevate light path 28 at an acute angle θ above horizontal. This configuration creates additional space for storing toner below imaging path 28 and below light module 24. Accordingly, an enlarged toner supply may be housed in a single chamber toner supply reservoir 48 that lies entirely below imaging light path 28.

Less expensive laser printers currently leave about 10% of the toner as waste. Therefore, it may be desirable in some configurations for an enlarged toner container 12 to also increase the size of waste toner reservoir 50, as shown in FIG. 9. Alternatively, as shown in the example of FIGS. 8 and 9, an auger or other suitable transport mechanism 78 may be used to return waste toner to supply reservoir 48 as used toner accumulates in a smaller waste reservoir 50, and as the supply of fresh toner in reservoir 48 dwindles.

Figure 10:
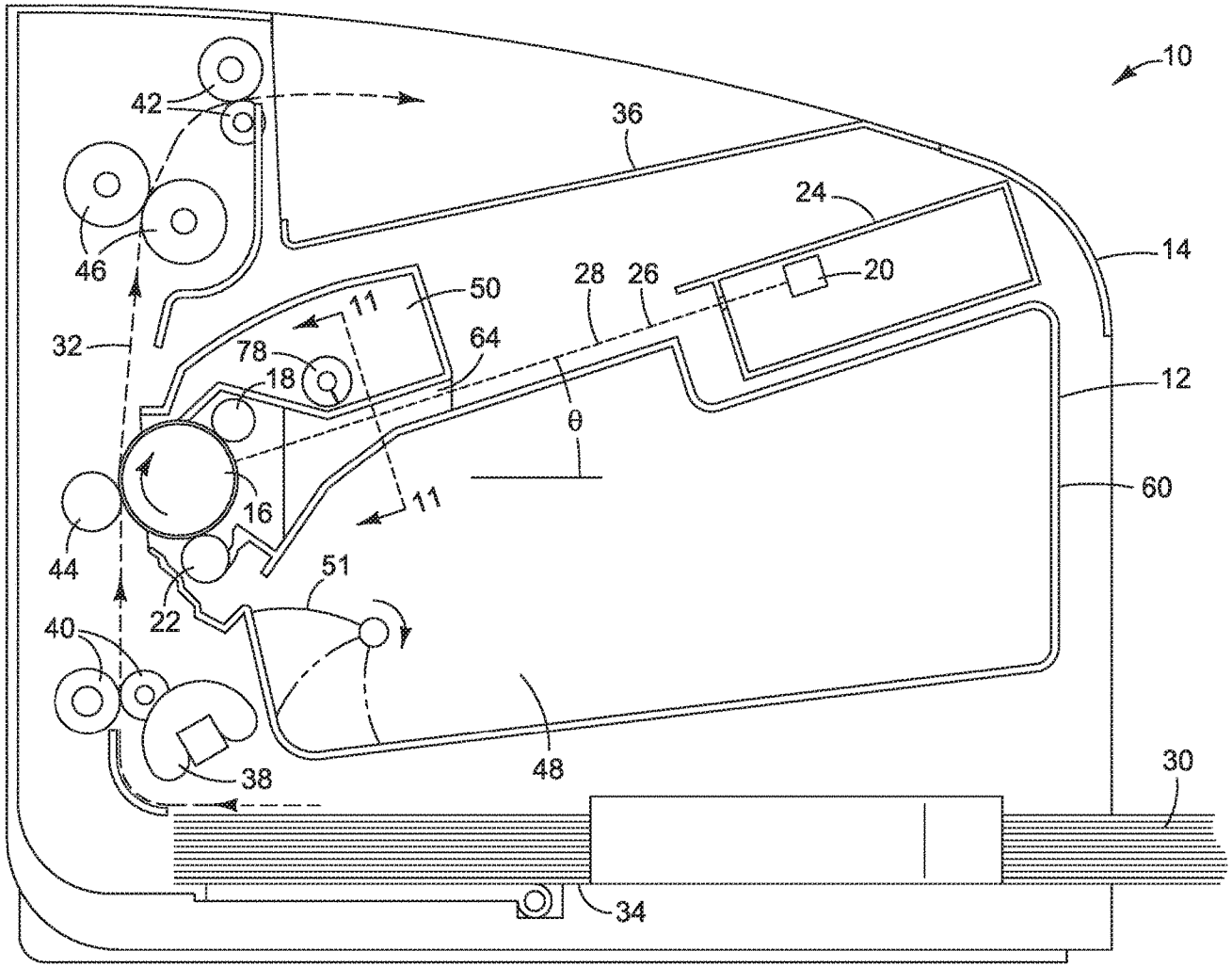
FIG. 10 is a side view illustrating one example of an electrophotographic printer and toner container in which the waste toner chamber is connected to the toner supply chamber so that used toner may be moved to the toner supply chamber.
Figure 11:
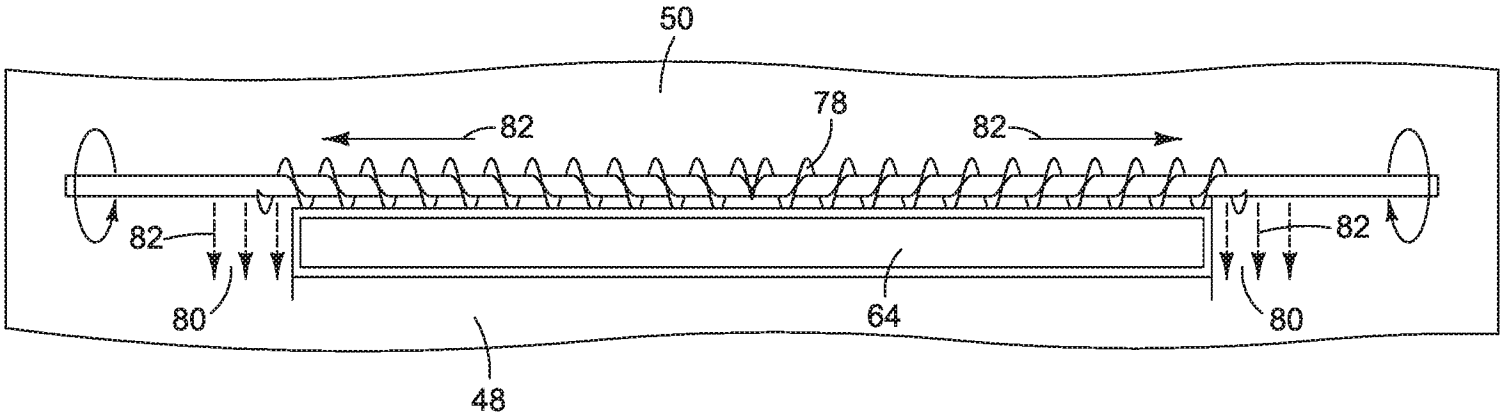
FIG. 11 is a section view taken along the lines 11-11 in FIG. 10.
Figure 12:
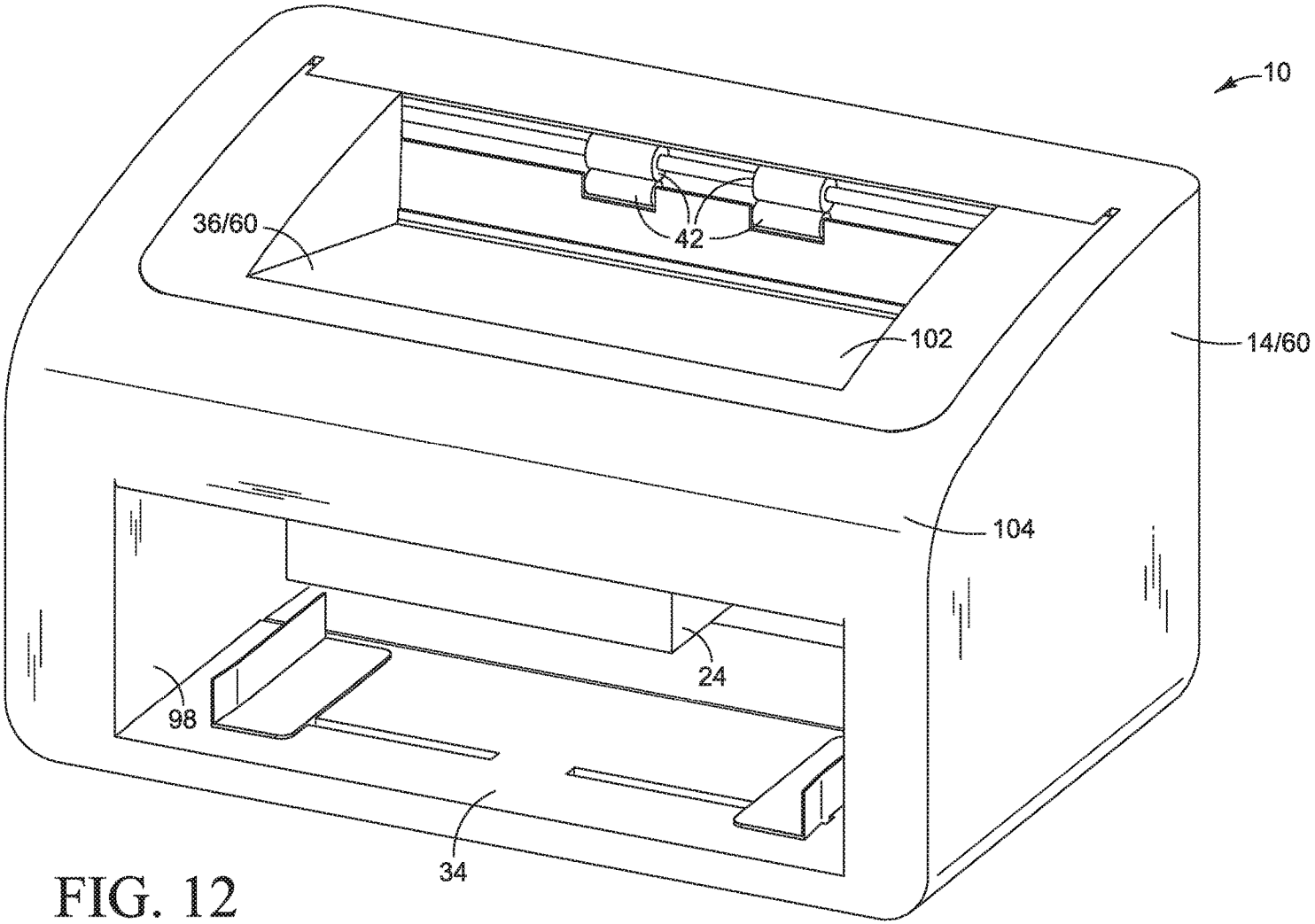
FIGS. 12 and 13 are perspective views illustrating one example of an electrophotographic printer and toner container in which the imaging light module and the toner container are combined into a single sub-assembly that is integrated into the printer housing.
Figure 13:
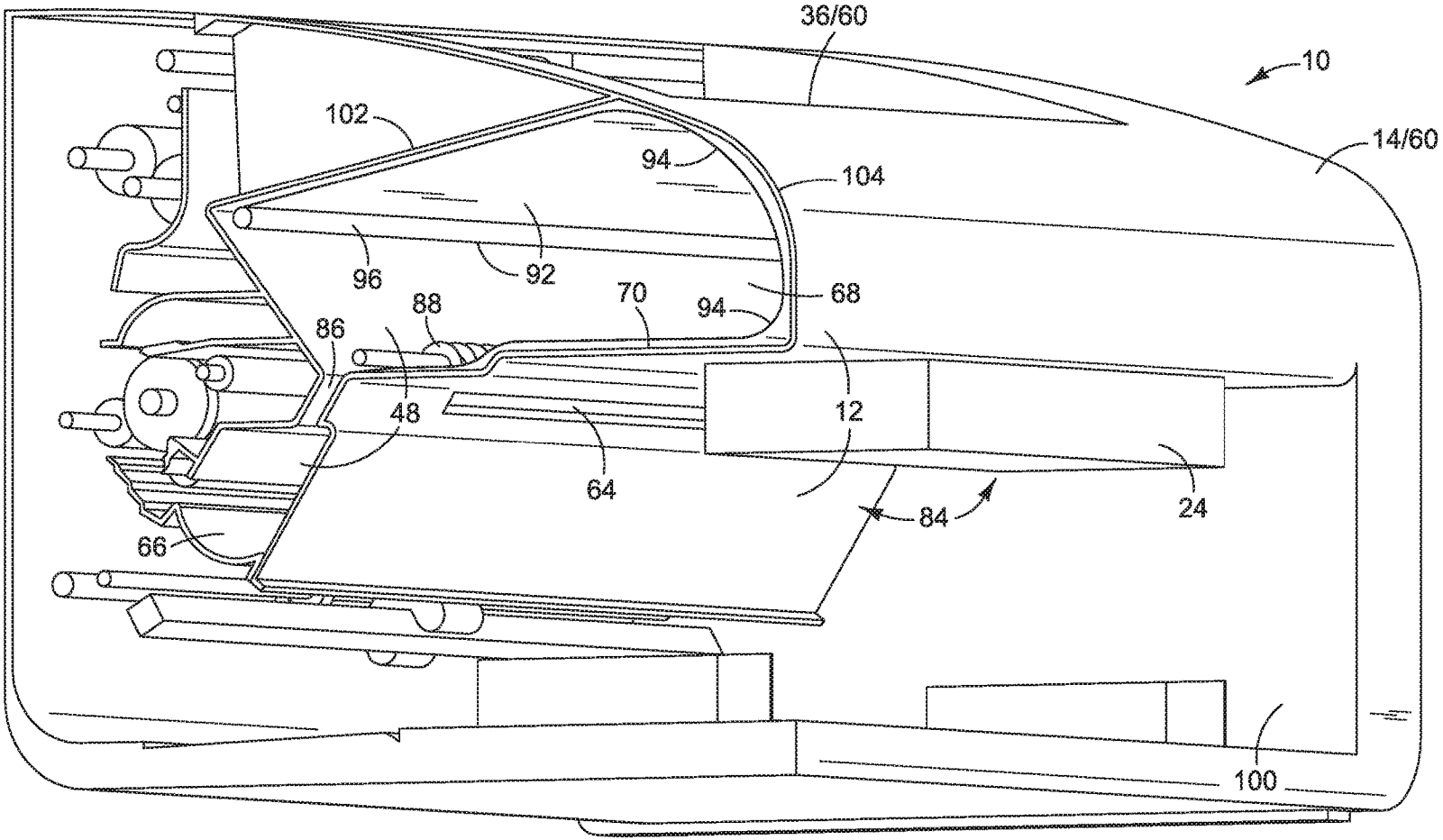
Figure 14:
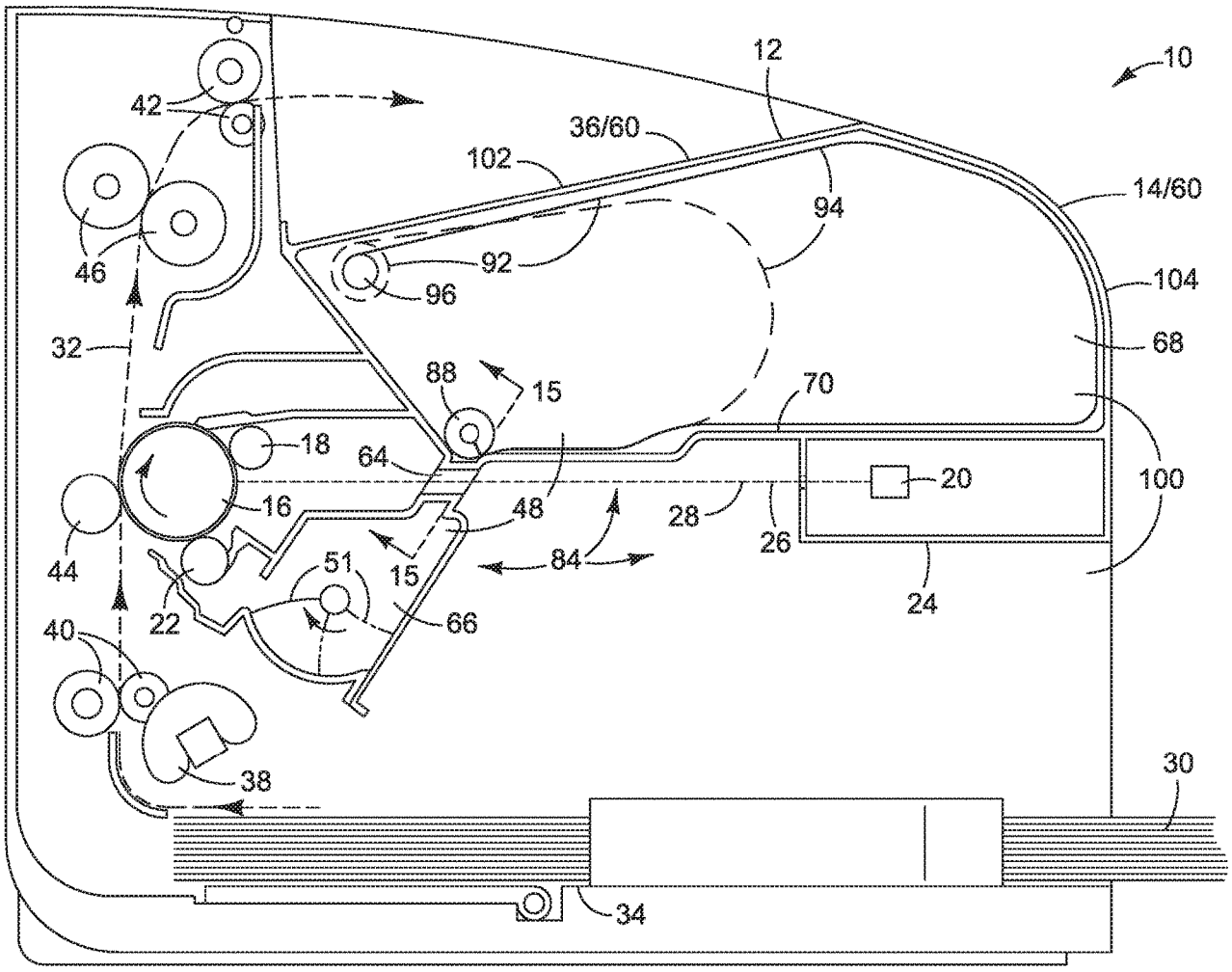
FIG. 14 is a side view of the printer and toner container shown in FIGS. 12 and 13.
Figure 15:
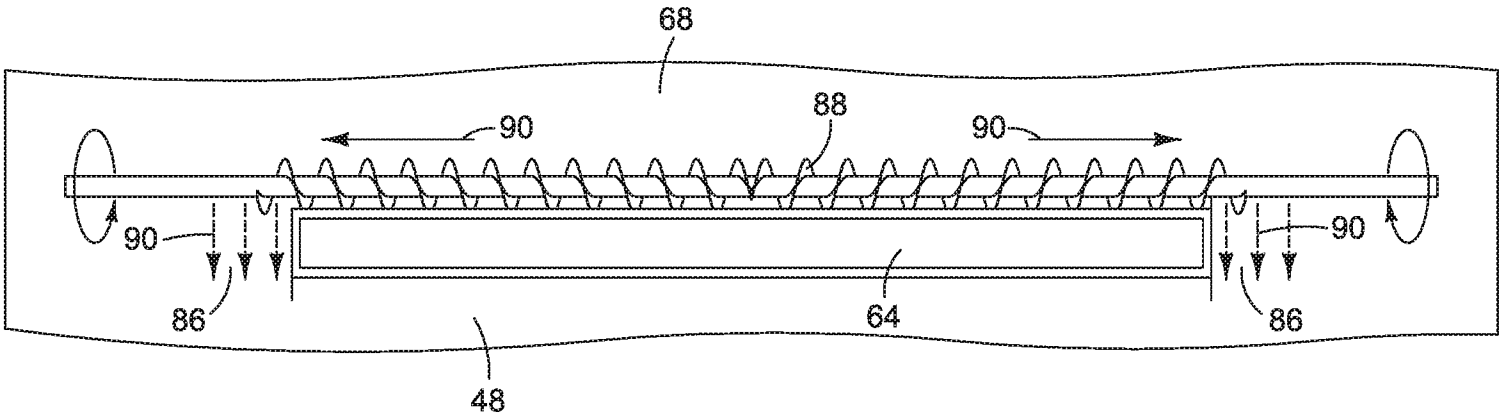
FIG. 15 is a section view taken along the line 15-15 in FIG. 14.

Referring to FIGS. 10 and 11, waste reservoir 50 is connected to supply reservoir 48 through channels 80 (FIG. 9) along both sides of an opening 64 that surrounds imaging light path 28. As best seen in FIG. 11, an auger 78 with opposing screw threads may be used to move waste toner simultaneously outboard to both channels 80, as indicated by direction/flow arrows 82. Waste toner channeled to supply reservoir 48 may be allowed to mix with the remaining fresh toner or a membrane (not shown) in supply reservoir 48 may be used to keep waste toner separate from the fresh toner.

FIGS. 12-15 illustrate an electrophotographic printer 10 and toner container 12 in which imaging light module 24 and toner container 12 are combined into a single sub-assembly 84 that is integrated into printer housing 14. (One side of printer housing 14 is removed in FIG. 13 to show the interior of toner container 12.) In some examples, a new enlarged toner container 12 makes it possible to eliminate the need for a replaceable toner cartridge, which, in turn, allows toner container 12 to be integrated as a permanent feature into the structure and/or exterior of printer 10.

Referring to FIGS. 12-15, toner supply reservoir 48 includes a smaller lower chamber 66 connected to a larger upper chamber 68 through channels 86 along both sides of an opening 64 that surrounds imaging light path 28. In this example for container 12, lower chamber 66 and the rearward part of container housing 60 mounting photoconductor 16, charging roller 18, and developer roller 22 use the same configuration as a conventional toner supply cartridge. This configuration for container 12 facilitates the adaptation of the new container for use in existing printer housings. An auger or other suitable transport mechanism 88 moves toner in upper chamber 68 to channels 86 where it can drop into lower chamber 66. As best seen in the section view of FIG. 15, an auger 88 with opposing screw threads may be used to move toner simultaneously to both channels 86, as indicated by direction/flow arrows 90.

In the example shown in FIGS. 12-15, the floor 70 of upper chamber 68 is substantially horizontal to help maximize storage capacity. Eventually, as the supply of toner in upper chamber 68 is depleted, the remaining toner will no longer flow to auger 88 at the urging of gravity alone. Hence, a collapsible liner or other suitable transport mechanism 92 is used to move the toner in upper chamber 68 to auger 88 where it can be channeled to lower chamber 66. Collapsible liner 92 is formed from a flexible sheet 94 lining chamber 68 and a winding roller 96. One end of sheet 94 is affixed to chamber floor 70 near auger 88 and the other end is affixed to roller 96. Sheet 94 is rolled onto roller 96 as the supply of toner in chamber 68 is depleted to shorten sheet 94 and shrink the volume of upper chamber 68, moving the remaining toner toward auger 88. A collapsing liner 92 is indicated by the dashed lines for sheet 94 in FIG. 14.

Imaging light module 24 is fastened to container housing 60 or otherwise integrated into container 12 to form a single sub-assembly 84. Container sub-assembly 84 is fastened to or otherwise integrated into printer housing 14 as a load bearing structure and/or as an exterior feature. In the example shown in FIGS. 12-14, container housing 60 (as part of sub-assembly 84) extends between (and includes) printer housing sidewalls 98, 100 across the front and interior portions of printer housing 14 to provide lateral structural support for printer 10. Sidewalls 98, 100, therefore, form part of printer housing 14 and part of container housing 60, and help define toner supply reservoir 48. Also, in this example the exterior top and forward portions 102, 104 of container housing 60 form the output tray 36 and the upper front exterior of printer housing 14, respectively.

Figure 16:
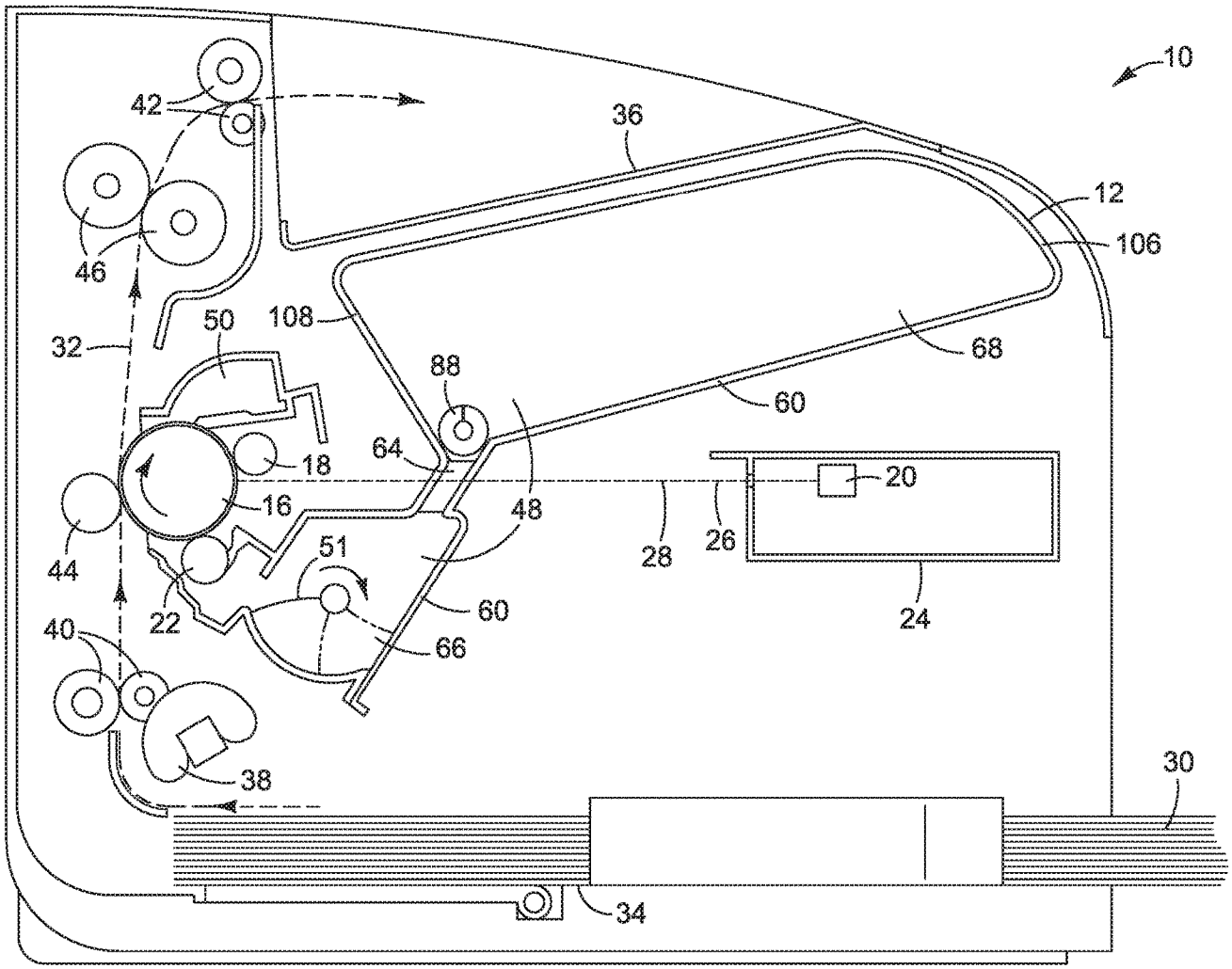
FIG. 16 is a side view illustrating another example of a toner container for an electrophotographic printer.

FIG. 16 is an elevation view illustrating another example of a new toner container 12 for an electrophotographic printer 10. FIG. 17 is a perspective view of toner container 12 from the printer of FIG. 16. FIGS. 18 and 19 are section views taken along the lines 18-18 and 19-19 in FIG. 17. The configuration of container 12 shown in FIGS. 16-19, is similar to the configuration of FIGS. 12-15 except that a sloped floor 70 in upper reservoir chamber 68 allows toner to move passively (under the influence of gravity) down to auger 88. The sloped floor decreases supply capacity but simplifies the design by eliminating the need for a collapsible liner or other such active transport mechanism to help move the toner to auger 88.

As noted at the beginning of this Description, the examples shown in the figures and described above illustrate but do not limit the invention. Other examples, embodiments and implementations are possible. Therefore, the foregoing description should not be construed to limit the scope of the invention, which is defined in the following claims.

The invention claimed is:

1. A toner cartridge for a printer, comprising:

a housing;

a photoconductor supported in the housing;

a developer roller supported in the housing adjacent to the photoconductor;

an imaging light module including a light source to expose the photoconductor to imaging light; and the housing including:

an exterior defining a pocket housing the imaging light module and an opening through which imaging light may pass from the light source through the housing along an imaging light path that extends longitudinally from the pocket toward the photoconductor, the opening diverging along the imaging light path laterally in a direction parallel to an axial length of the photoconductor from a narrower upstream part to a broader downstream part at the photoconductor; and an interior region defining a toner supply reservoir surrounding the opening and the imaging light module, the toner supply reservoir having a lower chamber below the opening and the imaging light module to supply toner to the developer roller directly, an upper chamber above the opening and the imaging light module to supply toner to the developer roller indirectly through the lower chamber, and a channel on each side of the opening connecting the upper chamber and the lower chamber.

2. The toner cartridge of claim 1, where the upper chamber is defined in part by a floor that slopes down laterally away from a higher part over the opening to a lower part at each channel.

3. The toner cartridge of claim 2, where the floor forms a peak at the higher part.

4. The toner cartridge of claim 1, where the housing is adapted for use in an existing printer housing.

5. The toner cartridge of claim 1, where the imaging light module is a removable component detachable from the housing.

6. A toner cartridge for a printer, comprising interconnected interior upper and lower toner supply chambers surrounding an exterior pocket to house an imaging light module and surrounding an exterior opening that extends from the pocket and that is defined in part by diverging sidewalls and a sloping ceiling.

7. The toner cartridge of claim 6, where the ceiling slopes from a peak at a middle part of the opening down to each of the diverging sidewalls.

8. The toner cartridge of claim 7, where the toner supply chambers are connected along the diverging sidewalls.

9. The toner cartridge of claim 8, comprising:

a photoconductor; and a developer roller adjacent to the photoconductor to receive toner from the lower supply chamber and apply toner to the photoconductor.

10. A toner cartridge for a printer, comprising:

a housing; and a toner supply reservoir in the housing, the toner supply reservoir surrounding a pocket for an imaging light module and surrounding an imaging light path from the pocket through the housing, and with a floor over the pocket and light path that slopes away from a higher part toward a lower part at each side of the reservoir.

11. The toner cartridge of claim 10, comprising:

a photoconductor supported in the housing; and a developer roller supported in the housing adjacent to the photoconductor.

12. The toner cartridge of claim 11, where the housing is adapted for use in an existing printer housing.

13. The toner cartridge of claim 11, comprising an imaging light module in the pocket, the imaging light module including a light source to expose the photoconductor to imaging light.

14. The toner cartridge of claim 10, where the floor forms a peak at the higher part.

15. The toner cartridge of claim 10, where floor forms a dome at the higher part.

16. The toner cartridge of claim 10 where:

an interior of the housing defines the supply reservoir; and an exterior of the housing includes a wedge shaped opening through which imaging light may pass along the light path from the pocket through the housing to a photoconductor when the cartridge is installed in a printer, the wedge shaped opening expanding laterally in a direction parallel to an axial length of the photoconductor from a narrower part at a front of the housing to a broader part at a rear of the housing.

* * * * *